US008192167B2

(12) United States Patent
Helmis et al.

(10) Patent No.: US 8,192,167 B2
(45) Date of Patent: Jun. 5, 2012

(54) BLADE FASTENING MEANS OF A TURBINE

(75) Inventors: Thomas Helmis, Mülheim an der Ruhr (DE); Michael Kleinhaus, Mülheim an der Ruhr (DE); Christoph Hermann Richter, Ibbenbüren (DE)

(73) Assignee: Siemens Aktiengesellschaft, München (DE)

( * ) Notice: Subject to any disclaimer, the term of this patent is extended or adjusted under 35 U.S.C. 154(b) by 602 days.

(21) Appl. No.: 12/310,412

(22) PCT Filed: Aug. 2, 2007

(86) PCT No.: PCT/EP2007/058001

§ 371 (c)(1),
(2), (4) Date: Feb. 24, 2009

(87) PCT Pub. No.: WO2008/022890

PCT Pub. Date: Feb. 28, 2008

(65) Prior Publication Data

US 2009/0324414 A1 Dec. 31, 2009

(30) Foreign Application Priority Data

Aug. 25, 2006 (EP) ..... 06017818

(51) Int. Cl.
*F01D 5/30* (2006.01)
*B63H 1/20* (2006.01)

(52) U.S. Cl. ..... 416/220 R; 416/221; 416/204 R

(58) Field of Classification Search ..... 416/220 R, 416/221

See application file for complete search history.

(56) References Cited

U.S. PATENT DOCUMENTS

| | | | | |
|---|---|---|---|---|
| 2,942,842 | A | 6/1960 | Hayes | |
| 4,778,342 | A | 10/1988 | Conlow | |
| 4,850,801 | A * | 7/1989 | Valentine | 416/205 |
| 4,877,376 | A * | 10/1989 | Sikorski et al. | 416/207 |
| 5,163,817 | A * | 11/1992 | Violette et al. | 416/204 A |
| 5,236,309 | A | 8/1993 | Van Heusden et al. | |
| 5,263,898 | A * | 11/1993 | Elston et al. | 416/147 |
| 5,431,542 | A | 7/1995 | Weisse et al. | |
| 6,213,719 | B1 | 4/2001 | Violette et al. | |
| 2004/0067137 | A1 | 4/2004 | Moroso | |

FOREIGN PATENT DOCUMENTS

| | | | |
|---|---|---|---|
| DE | 834408 | C | 3/1952 |
| EP | 1643082 | A1 | 4/2006 |
| JP | 57038603 | A | 3/1982 |
| JP | 57198301 | A | 12/1982 |
| JP | 59097207 | A | 6/1984 |
| JP | 59192801 | A | 11/1984 |
| JP | 10299407 | A | 11/1998 |
| JP | 11182494 | A | 7/1999 |
| JP | 2002332802 | A | 11/2002 |

OTHER PUBLICATIONS

Communication from China Patent Agent (H.K.) Ltd., Jul. 6, 2011, pp. 1-2, 1-4.
Communication from Yamaguchi Internaitonal Patent Office, Jul. 11, 2011, pp. 1-2, 1-5.

* cited by examiner

*Primary Examiner* — Nitin Parekh

(57) ABSTRACT

A turbine-blade locking device having a wedge movable in an axial direction is disclosed. The wedge is movable in the axial direction by a tensioning device, as a result of which a force is produced in the axial direction. The force in the axial direction causes the turbine blade to be pressed against the blade holder.

17 Claims, 5 Drawing Sheets

BLADE FASTENING MEANS OF A TURBINE

CROSS REFERENCE TO RELATED APPLICATIONS

This application is the US National Stage of International Application No. PCT/EP2007/058001 filed Aug. 2, 2007, and claims the benefit thereof. The International Application claims the benefits of European Patent application No. 06017818.3 EP filed Aug. 25, 2006, both of the applications are incorporated by reference herein in their entirety.

FIELD OF INVENTION

The invention refers to a turbine blade locking device for a turbomachine.

BACKGROUND OF INVENTION

Blade fastening means of the aforementioned type as a rule are used for fastening rotor blades on a rotor of a turbomachine, such as a steam turbine, which rotor blades rotate at high speed during rotation of the rotor. As a result of the fast rotation of the rotor, the associated rotor blades are subjected to a high centrifugal force. The blade root of the blades is therefore exposed to high forces and is displaced by a high degree radially outwards in a slot on the blade holder. Furthermore, the blades are exposed to severe vibrational loads so that mechanical damage, material fatigue, and corrosion on the slot can occur, and a shifting movement of the blade root inside the slot can occur.

For fixing the blade root inside the slot, various solutions, such as metal wedges, spring rings or sealing pieces, are known. Metal wedges certainly create a locking of the associated blade root inside a slot both axially and radially, but with large blades it is difficult with such metal wedges for retaining forces to be adequately created in the radial direction during rotation of the blade. Disk springs create only radial retaining forces and require additional expenditure for locking in the longitudinal direction of the associated slot. Furthermore, time-consuming measurements are required for disk springs during installation. As sealing pieces, two parts must always be provided, the installation of which furthermore partially necessitates the machining of the parts by hand.

SUMMARY OF INVENTION

An object of the invention is to provide a turbine blade locking device in which a precise and low-vibration retention of turbine blades in associated blade holders is ensured throughout a long operating period.

The object is achieved by means of a turbine blade locking device which comprises a wedge which is movable in an axial direction, wherein a tensioning means interacts with the wedge in such a way that the wedge is movable by means of the tensioning means in the axial direction, wherein the wedge is formed in such a way that the movement of the wedge in the axial direction leads to a force upon a turbine blade, which is to be locked, in the radial direction.

The invention is based on the idea that the turbine blade which is to be locked and is retained in a blade holder, has to be locked as a result of a radially acting force. The tensioning means in this case undertakes the task of moving the wedge in the axial direction. As a result of the movement of the wedge, a radial force ensues, which acts upon the turbine blade in a radial direction. As a result of a minimal movement of the turbine blade in the radial direction the blade root is pressed into the blade holder. The turbine blade is consequently locked in such a way that a tilting movement is virtually avoided.

Advantageous developments are described in the dependent claims. Thus, it is advantageous if the wedge abuts against a corresponding turbine blade root abutment face in the turbine blade which is to be locked. As a result, an opportunity is presented of producing the wedge and/or the turbine blade simply and inexpensively in order to maintain a best possible force transfer.

In a further advantageous development, the wedge is abutted against a corresponding rotor-surface abutment face. This would be an alternative way of forming the turbine blade locking device. Instead of abutting the beveled wedge surface against the turbine blade root, in this advantageous development it is proposed to abut the wedge against a corresponding beveled wedge surface in the blade holder. This has the advantage that the blade root does not have to be machined. Moreover, this has a favorable effect upon the force flux in the root.

In an advantageous development, a milled piece is provided, which has the rotor-surface abutment face. This has the advantage that the blade holder only has to be constructed with a slot, and that the milled piece can be inserted in the slot. The milled piece can be prefabricated in large quantities. The blade holder can be simply produced as a result since only a slot is required.

In a further advantageous development, the tensioning means has a thread which engages in a complementary mating thread in the wedge. Consequently, with simple means the tensioning means is developed in such a way that it can be easily produced. The wedge is moved by the tensioning means being rotated. Depending upon which pitch the thread has, the transferable force to the turbine blade root is different.

In a further advantageous development, a locking segment is provided, which is formed in such a way that an unwanted detachment of the tensioning means from the wedge is prevented. As a result, it becomes possible to position the wedge securely and in a fixed manner, wherein detachment is to be excluded by means of the locking segment.

The locking segment is advantageously constructed as a plate, and the locking of the tensioning means is carried out by bending over or flanging of the plate on the tensioning means. As a result, it is very simple to lock the tensioning means, which naturally has a screw head or similar, with the locking segment. A simple bending over of the plate is sufficient to lock the tensioning means. In a further advantageous development, a locking means is provided for exerting a spring force in the radial direction. The locking means compensates for a slot widening for small speed ranges.

The locking means is advantageously formed as a disk spring.

BRIEF DESCRIPTION OF THE DRAWINGS

An exemplary embodiment of a blade fastening according to the invention is explained in more detail in the following, with reference to the attached schematic drawings. In the drawing.

DETAILED DESCRIPTION OF INVENTION

Figure 1:
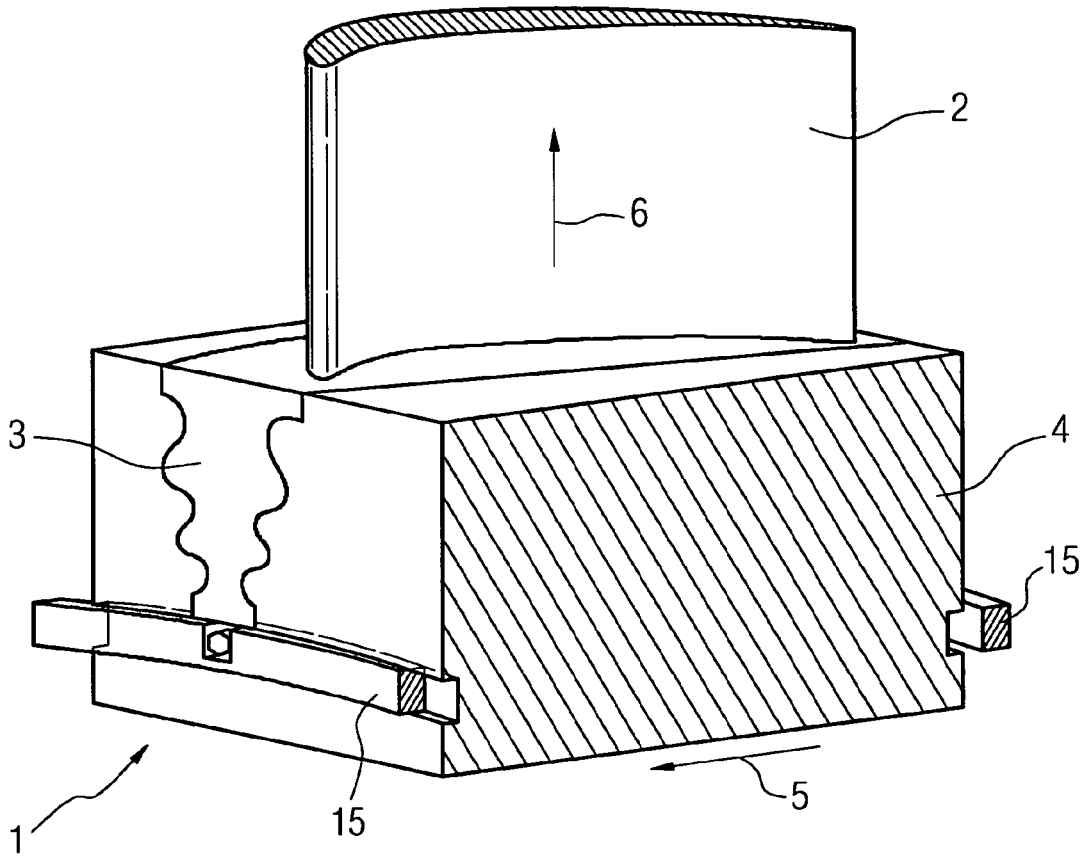
FIG. 1 shows a perspective view of the turbine blade locking device in the installed state.

In FIG. 1, a perspective view of a turbine blade locking device 1 is to be seen. A turbine blade 2 comprises a blade root 3. The blade root 3 is constructed in a known manner as a fir-tree root. The blade root 3 is arranged in a blade holder 4. The blade holder 4 correspondingly has a fir-tree shape which is formed complementarily to the blade root 3. The turbine blade 2 has to be locked both in the axial direction 5 and in the radial direction 6. The blade holder 4 for example can be a rotor.

Figure 2:
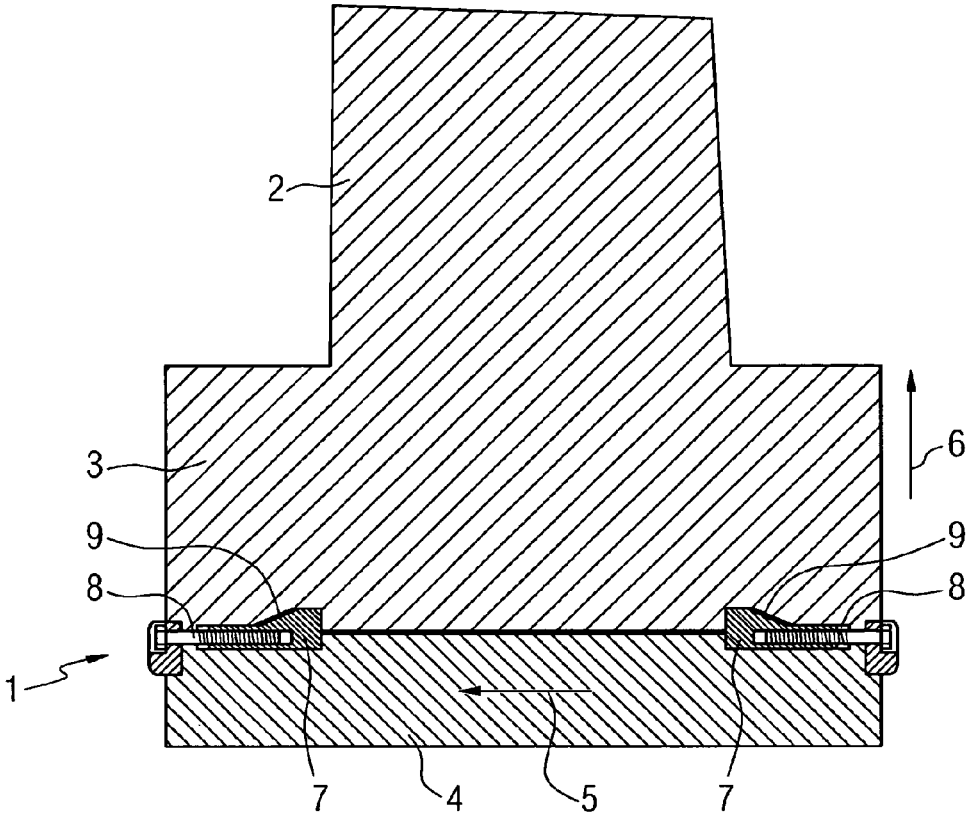
FIG. 2 shows a sectional view through the turbine blade locking device.

In FIG. 2, a turbine blade locking device 1 is to be seen in a sectional view. The turbine blade locking device 1 comprises a wedge 7 which is movable in the axial direction 5, wherein a tensioning means 8 interacts with the wedge 7 in such a way that the wedge 7 is movable by means of the tensioning means 8 in the axial direction 5. The wedge 7 abuts against a turbine blade root abutment face 9. As a result of the movement of the wedge 7 against the turbine blade root abutment face 9, a force ensues in the radial direction 6.

The tensioning means 8 comprises a thread 10. The wedge 7 correspondingly has a bore 11 with a corresponding mating thread 12. Rotation of the tensioning means 8 brings about a movement of the wedge 7 in the axial direction 5. The tensioning means 8 in this case has a customary screw head 13. The screw head 13 can be formed as a hexagon 14 and can be moved with a commercially available open-ended spanner. In this case a predetermined torque can be set.

The turbine blade locking device 1 is formed with a locking segment 15. The locking segment 15 prevents an unwanted detachment of the tensioning means 8 from the wedge 7. For this purpose, the locking segment 15 is constructed as a plate. The locking of the tensioning means 8 is carried out by bending over or flanging of the plate around the tensioning means 8.

The plate can naturally be bent over on the screw head 13 in order to avoid rotation of the tensioning means 8 as a result.

The turbine blade locking device 1 furthermore has a locking means 16 which is formed for exerting a spring force in the radial direction 6. For that reason the locking means 16 is formed as a disk spring and is arranged in a locking slot 17.

Figure 4:
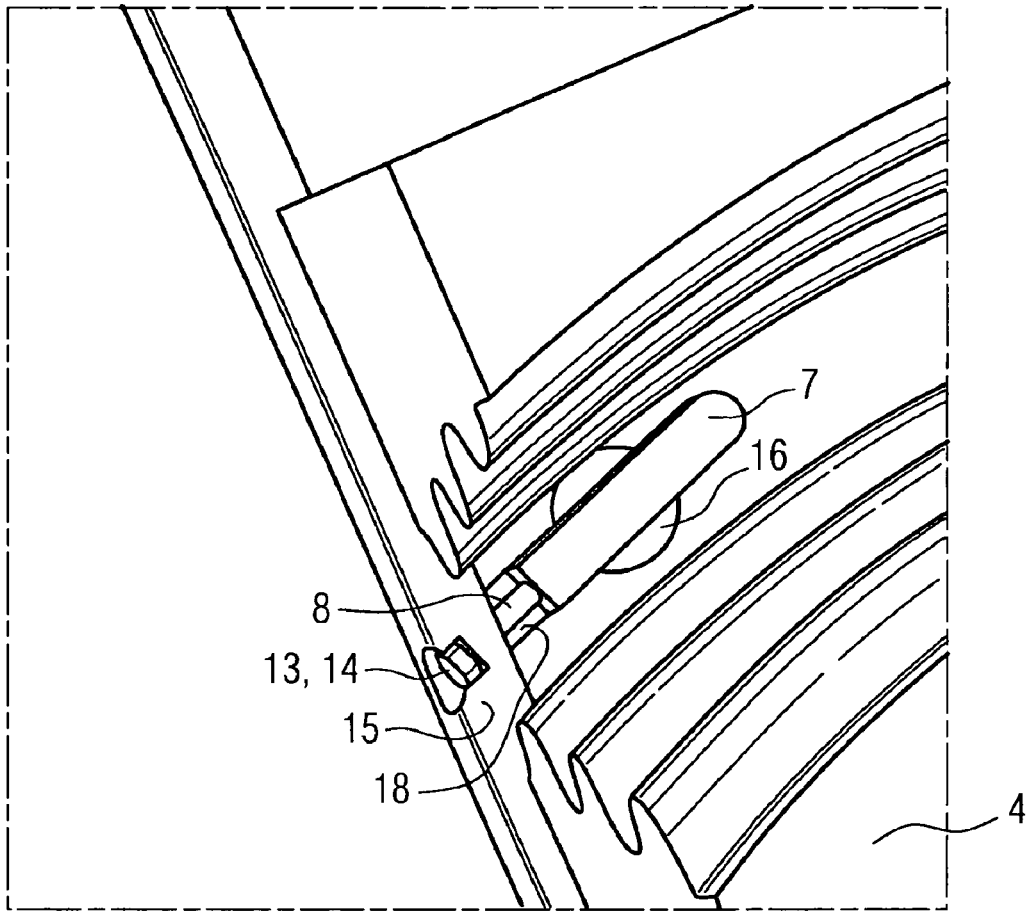
FIG. 4 shows a perspective view of the blade holder without the turbine blade.

In FIG. 4, a perspective view of the blade holder is to be seen, wherein the turbine blade 2 is not shown. The wedge 7 is of elongated form and arranged in a matching slot 18.

Figure 5:
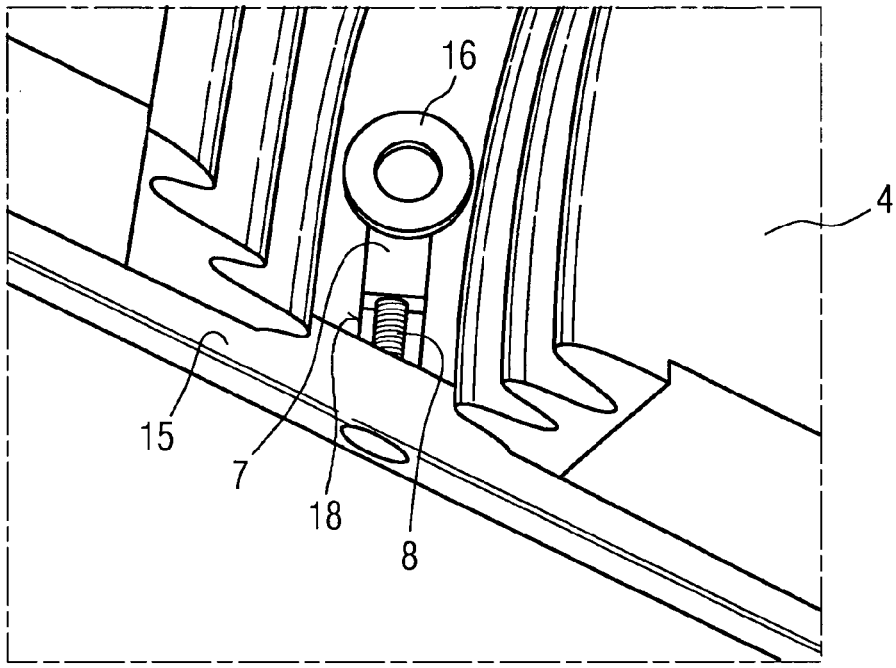
FIG. 5 shows a perspective view of an alternative embodiment of the turbine blade locking device without the installed turbine blade.

In FIG. 5, an alternative embodiment of the turbine blade locking device 1 is shown. However, the turbine blade 2 has been omitted in FIG. 5 so that only the blade holder 4 is to be seen. The blade holder 4 in this case is formed with a corresponding slot 19. A milled piece 20 is arranged in the slot 19. The milled piece 20 has a rotor-surface abutment face 21. The rotor-surface abutment face 21 essentially has the same function as the turbine blade root abutment face 9, specifically to transfer a force of the wedge 7 in the radial direction 6.

Figure 3:
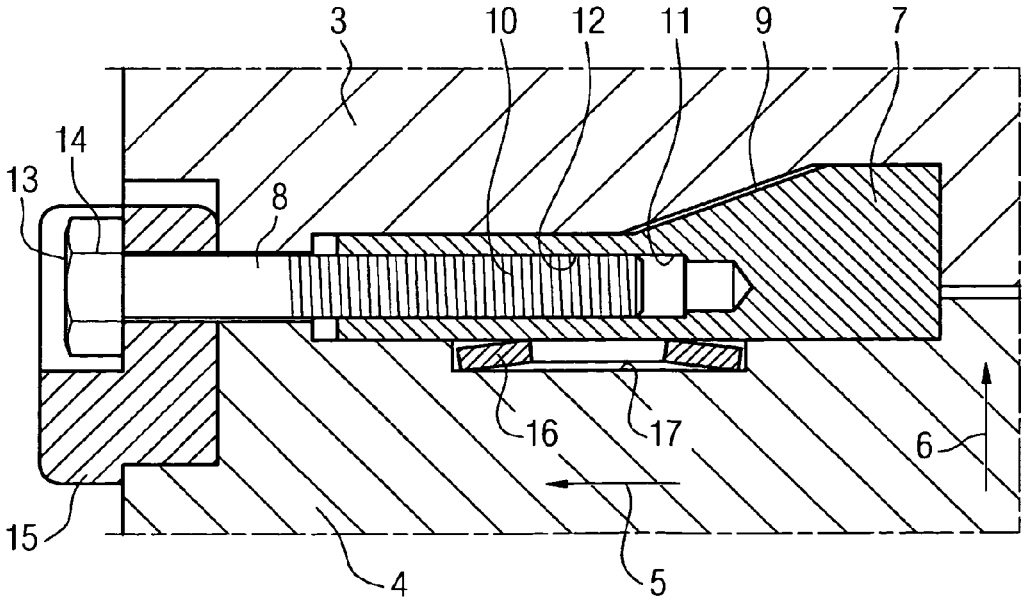
FIG. 3 shows an enlarged view of a partial detail from FIG. 2.

The locking means 16 in this case is arranged between the wedge 7 and the turbine blade 2. The locking means 16 in this case undertakes the same tasks as described for FIGS. 2 and 3.

In FIG. 5, the wedge 7 and the locking means 16 in the installed state is shown.

Figure 6:
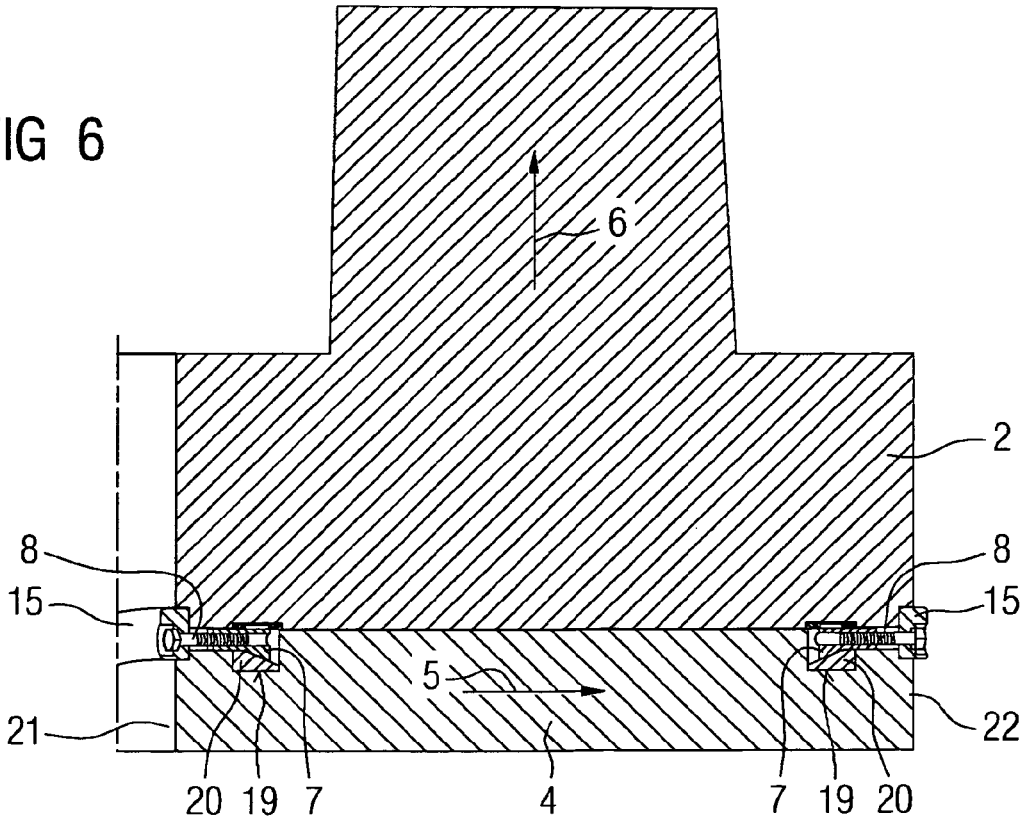
FIG. 6 shows a cross-sectional view of an alternative embodiment of the turbine blade locking device.

In FIG. 6, a sectional view through the turbine blade locking device 1 is to be seen. Naturally, it is advantageous if the arrangement according to the invention, consisting of tensioning means and wedge, is arranged at the ends 21, 22.

Figure 7:
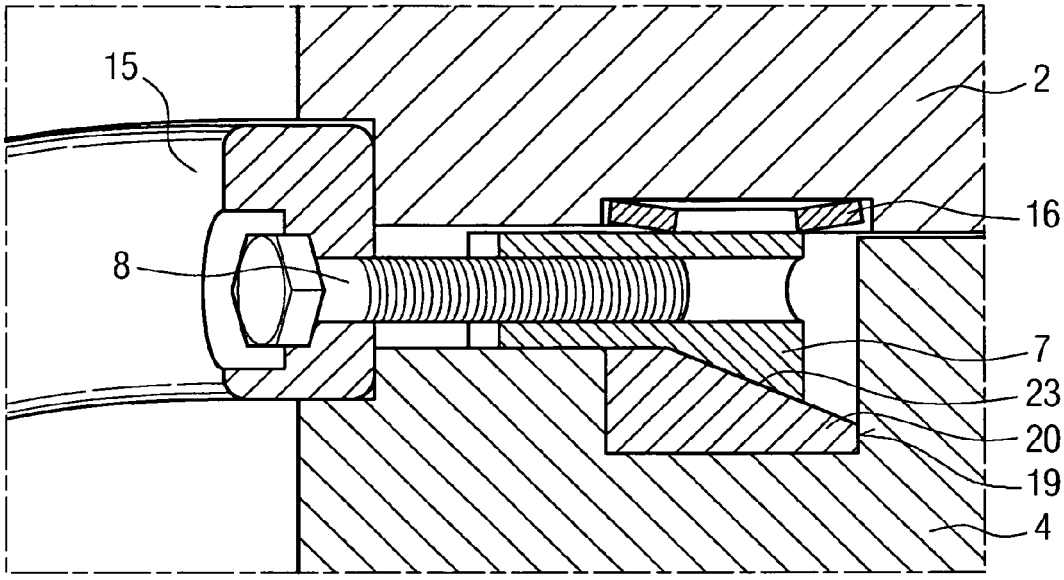
FIG. 7 shows an enlarged view of a detail from FIG. 6.

In FIG. 7, an enlarged view of the turbine blade locking device 1 from FIG. 6 is to be seen.

Figure 8:
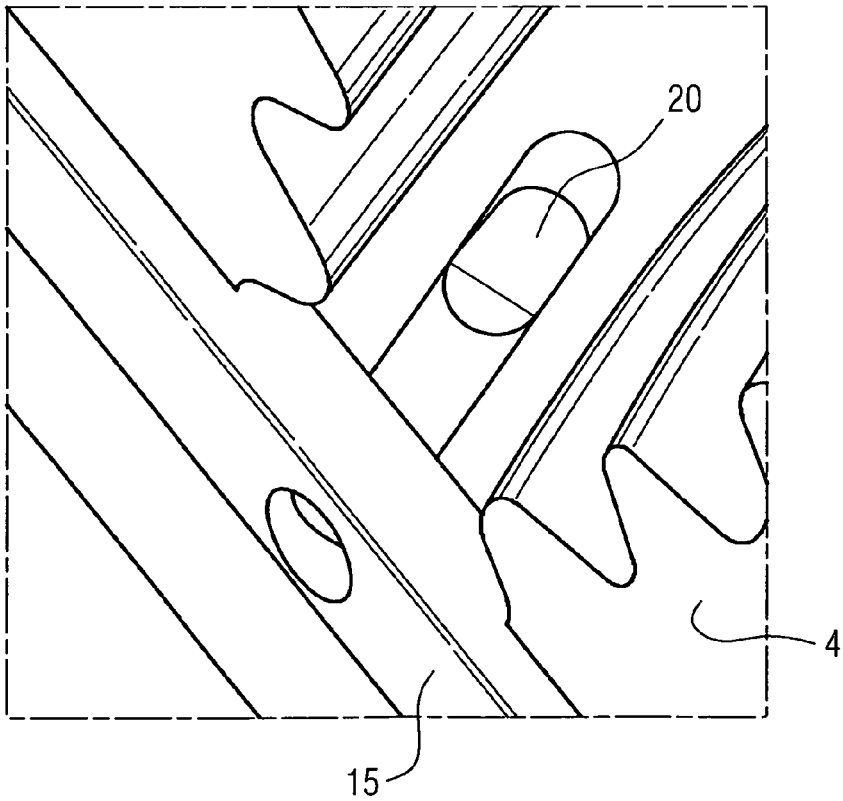
FIG. 8 shows a perspective view of the turbine blade locking device without the wedge and without the turbine blade.

In FIG. 8, a perspective view of the blade holder 4 is to be seen, wherein the tensioning means 8 and the wedge 7, and also the locking means 16, are not shown. FIG. 8 impressively shows that the milled piece 20 is to be simply produced and can easily be installed in the blade holder 4.

The milled piece 20 can be formed with a circular shape at its ends. This has the advantage that notch stresses can be minimized as a result.

The invention claimed is:

1. A turbine blade locking device, comprising:

a wedge movable in an axial direction, the wedge having a first thread;

a tensioning device interacting with the wedge such that the wedge is movable by the tensioning device in the axial direction, the tensioning device having a second thread which engages in the first thread of the wedge, the first thread being a complementary mating thread to the second thread, wherein the wedge is formed such that the movement of the wedge in the axial direction causes the wedge to abut against a corresponding abutment face of a turbine blade to impart a force upon the turbine blade to be locked in a radial direction.

2. The turbine blade locking device as claimed in claim 1, wherein the wedge abuts against a corresponding rotor-surface abutment face.

3. The turbine blade locking device as claimed in claim 2, wherein a milled piece is provided, which has the rotor-surface abutment face.

4. The turbine blade locking device as claimed in claim 3, wherein the milled piece is arranged in a corresponding slot of a blade holder.

5. The turbine blade locking device as claimed in claim 4, further comprising:

a locking segment formed such that an unwanted detachment of the tensioning device from the wedge is prevented.

6. The turbine blade locking device as claimed in claim 5, wherein the locking segment is constructed as a plate, and the locking of the tensioning device is carried out by bending over the plate on the tensioning device.

7. The turbine blade locking device as claimed in claim 5, wherein the locking segment is constructed as a plate, and the locking of the tensioning device is carried out by flanging of the plate on the tensioning device.

8. The turbine blade locking device as claimed in claim 4, further comprising:

a locking device for exerting a spring force in the radial direction.

9. The turbine blade locking device as claimed in claim 8, wherein the locking device is formed as a disk spring.

10. The turbine blade locking device as claimed in claim 8, wherein the locking device is arranged in a locking slot.

11. The turbine blade locking device as claimed in claim 1, further comprising:

a locking segment formed such that an unwanted detachment of the tensioning device from the wedge is prevented.

12. The turbine blade locking device as claimed in claim 11, wherein the locking segment is constructed as a plate, and the locking of the tensioning device is carried out by bending over the plate on the tensioning device.

13. The turbine blade locking device as claimed in claim 11, wherein the locking segment is constructed as a plate, and the locking of the tensioning device is carried out by flanging of the plate on the tensioning device.

14. The turbine blade locking device as claimed in claim 1, further comprising:

a locking device for exerting a spring force in the radial direction.

15. The turbine blade locking device as claimed in claim 14, wherein the locking device is formed as a disk spring.

16. The turbine blade locking device as claimed in claim 14, wherein the locking device is arranged in a locking slot.

17. A turbine blade locking device, comprising:

a wedge movable in an axial direction, the wedge having a first thread;

a tensioning device interacting with the wedge such that the wedge is movable by the tensioning device in the axial direction, the tensioning device having a second thread which engages in the first thread of the wedge, the first thread being a complementary mating thread to the second thread, wherein the wedge is formed such that the movement of the wedge in the axial direction causes the wedge to abut against a corresponding abutment face of a turbine blade to impart a force upon the turbine blade to be locked in a radial direction;

a locking segment formed such that an unwanted detachment of the tensioning device from the wedge is prevented; and a locking device for exerting a spring force in the radial direction.

* * * * *